US011717463B2

(12) United States Patent
Moridaira

(10) Patent No.: US 11,717,463 B2
(45) Date of Patent: Aug. 8, 2023

(54) HEALTH ROD

(71) Applicant: JUTE inc., Tokyo (JP)

(72) Inventor: Shigeo Moridaira, Tokyo (JP)

(73) Assignee: JUTE inc., Tokyo (JP)

( * ) Notice: Subject to any disclaimer, the term of this patent is extended or adjusted under 35 U.S.C. 154(b) by 218 days.

(21) Appl. No.: 16/620,528

(22) PCT Filed: Sep. 30, 2019

(86) PCT No.: PCT/JP2019/038617
§ 371 (c)(1),
(2) Date: Mar. 16, 2020

(87) PCT Pub. No.: WO2020/129350
PCT Pub. Date: Jun. 25, 2020

(65) Prior Publication Data

US 2020/0237603 A1 Jul. 30, 2020

(30) Foreign Application Priority Data

Dec. 20, 2018 (JP) ..... 2018-238618

(51) Int. Cl.
*A61H 7/00* (2006.01)
*A61H 39/04* (2006.01)

(52) U.S. Cl.
CPC ..... *A61H 7/003* (2013.01); *A61H 39/04* (2013.01); *A61H 2201/0153* (2013.01); *A61H 2201/1253* (2013.01); *A61H 2201/169* (2013.01)

(58) Field of Classification Search
CPC ..... A61H 7/003; A61H 2201/0153; A61H 2201/169; A61H 2201/1253; A61H 11/00;
(Continued)

(56) References Cited

U.S. PATENT DOCUMENTS 1,882,490 A * 10/1932 Falck ..... A61H 15/0092 601/120
4,712,539 A * 12/1987 Kim ..... A61H 15/0092 601/120

(Continued)

FOREIGN PATENT DOCUMENTS

JP H09-276363 A 10/1997
JP 3183276 U 5/2013
JP 6211224 B 10/2017

OTHER PUBLICATIONS

Merriam Webster—Definition of Rod, 2022. (Year: 2022).*

*Primary Examiner* — Justine R Yu
*Assistant Examiner* — Benjamin M. Kusiak
(74) *Attorney, Agent, or Firm* — Yokoi & Co., U.S.A.; Toshiyuki Yokoi

(57) ABSTRACT

There is provided a health instrument with which, even though a treating person is a treatment subject, the treating person is capable of performing a predetermined treatment, and which efficiently restores a human soft tissue into a normal state by properly coping with a difference in human soft tissue such as a fascia or a muscle, which is induced by a difference in physique, or the like. There is provided a health instrument with a rod shape which has at least one or more grip portions and a treatment portion extending along a length direction, in which the treatment portion has a curved portion in a width direction, and in a cross-sectional shape which is obtained when cutting the treatment portion at a midpoint along the length direction, has four or more protrusions on a periphery of a cross section, and tip portions of the protrusions are curved.

9 Claims, 8 Drawing Sheets

(58) Field of Classification Search
CPC .... A61H 15/0092; A61H 19/40; A61H 19/44; A61H 7/001–003; A61H 2201/0157; A61H 2201/1692; A61H 2201/1695; A61H 39/04
USPC ..... 601/84, 95, 134–138; D24/214, 215
See application file for complete search history.

(56) References Cited

U.S. PATENT DOCUMENTS 4,993,408 A * 2/1991 Schweisfurth ..... A61H 15/0092 601/123
D342,999 S * 1/1994 Gonsalves, Jr. ..... D28/99
6,241,693 B1 * 6/2001 Lambden ..... A61H 15/0092 601/129
6,887,211 B1 * 5/2005 Sevier ..... A61H 7/001 601/135
D616,107 S * 5/2010 Cochard ..... D24/214
D617,908 S * 6/2010 Nuenke ..... D24/214
D632,400 S * 2/2011 Bludorn ..... D24/189
D662,601 S * 6/2012 Matsushita ..... D24/215
D666,734 S * 9/2012 Takashima ..... D24/215
D687,957 S * 8/2013 Heskier ..... D24/215
D712,563 S * 9/2014 Pursel ..... D24/171
D721,440 S * 1/2015 Pursel ..... A61H 7/007 D24/214
D722,174 S * 2/2015 Almarales ..... D24/214
D736,400 S * 8/2015 Matsuura ..... D24/215
D752,239 S * 3/2016 Stock ..... D24/214
D763,460 S * 8/2016 Almarales ..... D24/214
D836,791 S * 12/2018 Tarashchansky ..... D24/215
D846,137 S * 4/2019 Li ..... D24/215
D854,178 S * 7/2019 Cochard ..... D24/214
D857,223 S * 8/2019 Nagata ..... D24/215
2001/0051778 A1 * 12/2001 Sevier ..... A61H 7/001 601/136
2010/0331744 A1 * 12/2010 Eitzen ..... A61H 23/02 601/120
2012/0259257 A1 * 10/2012 Nelson ..... A61H 39/04 601/119
2013/0158602 A1 * 6/2013 Harada ..... A61B 17/54 606/239
2014/0005581 A1 * 1/2014 Scappaticci ..... A61H 7/001 601/138
2014/0342881 A1 * 11/2014 Almarales ..... A63B 23/10 482/91
2015/0231014 A1 * 8/2015 Capobianco ..... B25F 1/00 7/151
2015/0245977 A1 * 9/2015 Sungarian ..... A61H 15/00 601/118
2019/0008716 A1 * 1/2019 Giddings ..... A61H 7/003
2019/0046392 A1 * 2/2019 Evans ..... A61H 7/001

* cited by examiner

HEALTH ROD

TECHNICAL FIELD

The present invention relates to a health instrument (sometimes called as a healthy instrument, a health device, a healthy device etc.) with which due to including a structure applicable to a wide variety of treatments, even though a treating person himself/herself is a treatment subject, the treating person is capable of performing a predetermined treatment, and restores a human soft tissue into a normal state by properly coping with a difference in human soft tissue such as a fascia or a muscle, which is induced by individual differences.

BACKGROUND ART

In the related art, various electric massage instruments are proposed as mechanical devices that alleviate a muscle fatigue state or a symptom such as muscle inflammation to promote restoring the muscle fatigue state or the symptom into a normal state.

However, various electric massage instruments require a large number of electric motors, control systems thereof, and the like, and not only overall structures tend to become complicated but also sizes and weights increase, and thus there is a problem that accommodation-ability and carrying-ability is inferior, or the like.

Accordingly, there is proposed a health instrument that provides outstanding massage effects and outstanding accommodation-ability or operability (for example, refer to Patent Document 1).

More specifically, the health instrument includes, as illustrated in FIG. 7, a shaft rod 209; a plurality of rollers 211 with a substantially annular shape which are provided in the shaft rod 209; and grip portions 213 with a substantially cylindrical shape which are provided at both ends of the shaft rod 209. The plurality of rollers is provided so as to be rotatable in a direction substantially perpendicular to an axial direction of the shaft rod 209. The shaft rod 209 further extends outward on both sides of the plurality of rollers 211.

Then, the health instrument is a multilayer rod-shaped health instrument with a structure in which the grip portion 213 is formed of a small diameter pole 203 that is slidable to stretch outward in the axial direction of the shaft rod 209, a medium diameter pole with a substantially cylindrical shape which includes a first center hole penetrating therethrough in an elongation direction, and a large diameter pole with a substantially cylindrical shape which includes a second center hole penetrating therethrough in the elongation direction, and in which the small diameter pole 203 is detachably inserted into the first center hole of the medium diameter pole, and the medium diameter pole is detachably inserted into the second center hole of the large diameter pole.

In addition, as a simple and cheap instrument, there is proposed a soft tissue restoration aid instrument for humans which is used in treatment to restore a human soft tissue such as a fascia or a muscle into a normal state (for example, refer to Patent Document 2).

More specifically, the soft tissue restoration aid instrument for humans is characterized in that the soft tissue restoration aid instrument for humans has, as illustrated in FIG. 8, a main body portion 101 which extends in a rod shape or a planar shape and has a thickness holdable by the hand, and a treatment portion 110 formed of a corner portion where a first surface 112 and a second surface 113, which are two surfaces provided in the main body portion 101, are connected to each other via a press portion 114 with an arc shape while forming an acute angle, and the treatment portion 110 is formed to extend in a curved line shape in such a manner to extend out convexly or be concaved.

CITATION LIST

Patent Document

Patent Document 1: JP 6211224 B1 (claims, FIG. 1, etc.)
Patent Document 2: JP 3183276 U (claims, FIG. 1, etc.)

SUMMARY OF THE INVENTION

Problem to be Solved by the Invention

However, there is a problem that the multilayer rod-shaped health instrument disclosed in Patent Document 1 or the soft tissue restoration aid instrument for humans disclosed in Patent Document 2 has difficulties in properly coping with individual differences in soft tissue such as a fascia or a muscle, which are induced by a difference in height or weight or a difference in health state or constitution between humans receiving a treatment.

Moreover, according to the soft tissue restoration aid instrument for humans disclosed in Patent Document 2, treatment effects can be obtained to some extent depending on a region receiving a treatment; however, it is not considered that a subject performs a treatment on his/her own, and thus it is necessary to prepare a treating person separately from the treatment subject.

Accordingly, as a result of intensive study, the inventors of the invention have found that if a health instrument is configured to have at least one or more grip portions and a treatment portion with a predetermined shape which extends along a length direction, it is possible to perform a treatment without distinguishing between a user himself/herself and others as a treatment subject, and it is easy to restore a human soft tissue into a normal state by properly coping with individual differences in human soft tissue such as a fascia or a muscle, and the inventors have completed the invention.

Namely, an object of the invention is to provide a health instrument with which due to including a structure applicable to a wide variety of treatments, even though a treating person himself/herself is a treatment subject, the treating person is capable of performing a predetermined treatment on his/her own, and is capable of restoring a human soft tissue such as a fascia or a muscle into a normal state by performing a treatment that properly copes with individual differences in human soft tissue.

Means for Solving Problem

According to the invention, there is provided a health instrument with a rod shape which has at least one or more grip portions and a treatment portion extending along a length direction, in which the treatment portion has a curved portion in a width direction, and in a cross-sectional shape which is obtained when cutting the treatment portion at a midpoint along the length direction, has four or more protrusions on a surface, and tip portions of the protrusions are curved. As a result, it is possible to solve the problems described above.

Namely, according to the health instrument of the invention, since the health instrument with a rod shape has at least the one or more grip portions and the treatment portion and has a large number of the protrusions and the curved portion, the structure is simple, it is easy to grip the health instrument, it is possible to perform a treatment without distinguishing between a user himself/herself and others as a treatment subject, and it is possible to perform a wide variety of treatments.

Therefore, since the tip portions of the protrusions are curved, it is possible to properly bring the protrusion into contact with the human body to be able to stably perform a treatment, and eventually, it is possible to more efficiently obtain the effect of restoring a human soft tissue such as a fascia or a muscle.

In addition, in configuring the health instrument of the invention, when the four or more protrusions include at least a first protrusion, a second protrusion, and a third protrusion, a longest protrusion among the four or more protrusions is the first protrusion, and protrusions adjacent on right and left sides are the second protrusion and the third protrusion, both or either one of a surface between the first protrusion and the second protrusion and a surface between the first protrusion and the third protrusion may be smooth curved surfaces.

It is possible to also rub against a human soft tissue such as a fascia or a muscle, as described above, using not only a plurality of the protrusions but also the smooth curved surfaces.

Therefore, in performing a wide variety of treatments, it is possible to properly perform a treatment also on a region not suitable for treatment by exerting a large pressing force.

Incidentally, the health instrument exemplarily illustrated in FIGS. 1A to 1D has, for example, the first to sixth protrusions. A portion denoted with number 12 corresponds to the first protrusion, a portion denoted with number 13 corresponds to the second protrusion, and a portion denoted with number 14 corresponds to the third protrusion.

In addition, in configuring the health instrument of the invention, when the four or more protrusions further include a fourth protrusion, a fifth protrusion, and a sixth protrusion, a protrusion adjacent to the second protrusion is the fourth protrusion, a protrusion adjacent to the third protrusion is the fifth protrusion, and a protrusion positioned between the fourth protrusion and the fifth protrusion is the sixth protrusion, both or either one of a surface between the fourth protrusion and the sixth protrusion and a surface between the fifth protrusion and the sixth protrusion may be curved surfaces which are concave inward in the cross-sectional shape, and the curved surfaces may be rough surfaces.

With the configuration described above, if a massage oil is used together, it is possible to evenly distribute the massage oil, and to increase also a force to hold the massage oil using the rough surface along the length direction of the treatment portion.

Incidentally, the health instrument exemplarily illustrated in FIGS. 1A to 1D has, for example, the first to sixth protrusions. A portion denoted with number 27 corresponds to the fourth protrusion, a portion denoted with number 26 corresponds to the fifth protrusion, and a portion denoted with number 29 corresponds to the sixth protrusion.

In addition, in configuring the health instrument of the invention, when the treatment portion is cut at the midpoint along the length direction, right and left cut segments may be asymmetrical in shape.

With the configuration described above, there is an increase in the number of the protrusions, the curved surfaces, or the like which have different shapes as portions usable in treatment, and thus it is possible to perform treatments to cope with more variety of human body regions.

In addition, in configuring the health instrument of the invention, a press portion which is curved inward may be provided between at least the one or more grip portions and the treatment portion.

With the configuration described above, it is possible to efficiently perform a treatment with a stronger pressing force by pressing the fingers or the like against the press portions which are curved inward of the health instrument with a rod shape, namely, are curved inward from an outer surface.

In addition, in configuring the health instrument of the invention, at least one of the grip portions may have a spoon-shaped concave portion and an edge.

With the configuration described above, it is possible to press a small human body region such as the fingertip or to effectively rub thereagainst using the edge or the tip portion, and it is possible to more suitably perform a treatment.

Moreover, it is possible to hold the spoon-shaped concave portion and the edge as the grip portion. Moreover, it is possible to tightly wrap a cloth, string, or the like around the grip portion, and thus it is possible to improve usability of the health instrument.

In addition, in configuring the health instrument of the invention, a communication portion may be provided between the spoon-shaped concave portion and the treatment portion.

With the configuration described above, it is possible to apply a proper amount of a massage oil or the like toward the treatment portion only by holding, for example, the massage oil or a massage wax in the spoon-shaped concave portion.

In addition, in configuring the health instrument of the invention, the health instrument may be formed of at least one of a metallic material, a ceramic material, a woody material, and a resin material (including a rubber material).

With the configuration described above, it is possible to appropriately change the weight, durability, smoothness, or the like of the health instrument, and eventually, it is possible to perform a proper treatment using the health instrument.

BRIEF DESCRIPTION OF DRAWINGS

(FIG. 1A is a front view, FIG. 1B is a cross-sectional view taken at a midpoint of a treatment portion (the same when seen from either one of directions B and C), FIG. 1C is a side view seen from the direction B, and FIG. 1D is a side view seen from the direction C);

(FIG. 3A is a top view and FIG. 3B is a bottom view);

(FIG. 5A is a front view, FIG. 5B is a top view, and FIG. 5C is a bottom view);

(FIG. 6A is a front view, FIG. 6B is a top view, and FIG. 6C is a bottom view);

MODE(S) FOR CARRYING OUT THE INVENTION

First Embodiment

The first embodiment is a health instrument 1 with a rod shape which has, as exemplarily illustrated in FIGS. 1A to 1D, at least one or more grip portions 11*a* and 11*b* and a treatment portion 10 extending along a length direction.

In addition, the health instrument 1 is characterized in that the treatment portion 10 has a curved portion 20 in a width direction and in a cross-sectional shape which is obtained when assuming A and A' as two points of midpoints along the length direction of the treatment portion 10 and cutting the treatment portion 10 along a line connecting A and A', has at least four or more protrusions 12, 13, 14, 26, 27, and 29 on a surface, and tip portions of the protrusions are curved.

Hereinafter, the health instrument 1 of the first embodiment will be specifically and appropriately described with reference to the drawings.

1. Basic Configuration

Figure 1A:
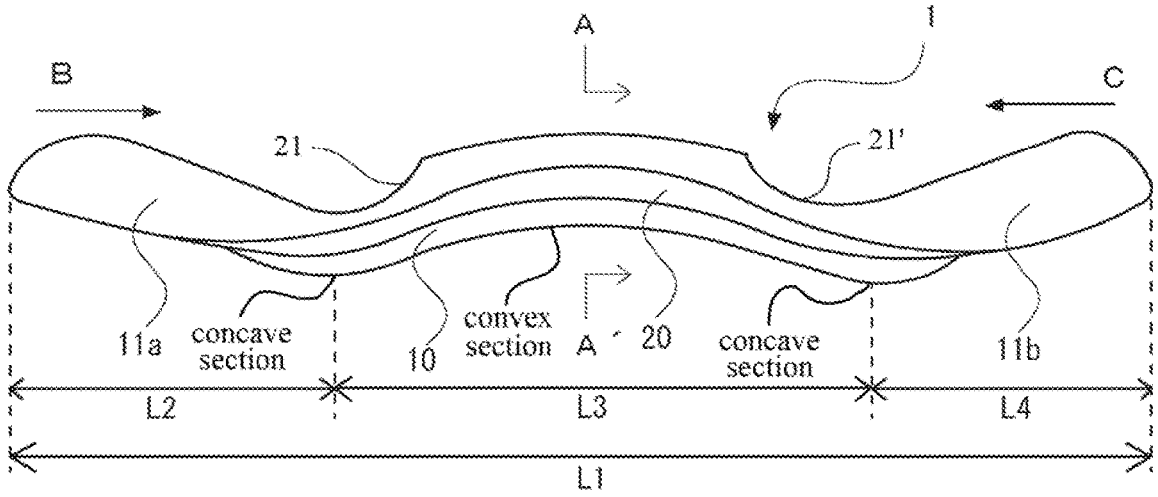
FIGS. 1A to 1D are views provided to describe a health instrument according to the invention

As illustrated in FIG. 1A, the health instrument 1 of the first embodiment is the health instrument 1 with a rod shape which has at least one or more grip portions 11*a* and 11*b* and the treatment portion 10 extending along the length direction, and is characterized in that the treatment portion 10 has the curved portion 20 in the width direction and has four or more protrusions on the surface in the cross-sectional shape which is obtained when cutting the treatment portion 10 along the line connecting the midpoints A and A' along the length direction.

With the configuration described above, a simple structure is attained, and it is possible to perform a treatment without distinguishing between a user himself/herself and others as a treatment subject, and to cope with a wide variety of treatments.

Namely, with a predetermined basic configuration having at least one or more grip portions 11*a* and 11*b* and the treatment portion 10, it is possible to suitably perform gripping, and if using a large number of the protrusions or the curved portion 20, it is possible to cope with a wide variety of treatments, and even though a treating person himself/herself is a treatment subject, the treating person is capable of performing a predetermined treatment on his/her own by using a large number of the protrusions or the curved portion 20.

(1) Formation Material

The type of the formation material of the health instrument 1 illustrated in FIGS. 1A to 1D and the like is not particularly limited; however, the health instrument 1 is preferably formed of at least one of, for example, a metallic material, a ceramic material, a woody material, or a metallic material of a resin material (including a rubber material).

The reason is that it is possible to appropriately change the lightweight properties (weight), durability, smoothness, and the like of the health instrument 1 by using the formation materials described above, and eventually, it is possible to perform a more proper treatment using the health instrument 1 over a long period of time.

Namely, the health instrument 1 made using the formation materials described above is capable of maintaining a strength where the health instrument 1 is not distorted or the like even though used a plurality of times.

In addition, according to the health instrument 1 made using the formation materials described above, it is possible to prevent damage or the like to a surface of the health instrument 1, which has the possibility of causing a laceration to a lesion site which is a subject, and the health instrument 1 is capable of maintaining lightweight properties (predetermined weight) which provide good handling-ability and carrying-ability.

Incidentally, if a material having an inferior vibration damping capacity is used as the formation material, it is possible to feel, through the health instrument 1, very small vibrations output from the lesion site during treatment.

Therefore, since a health state or the like of the lesion site may be read, a metallic material is more preferably used as the formation material.

Then, as a type of metallic material, aluminum or aluminum alloys (Number 2011, 2014, 2017, 2024, 2117, 2219, 3003, 3004, 5005, 5086, 6063, 7075, and the like which are made in accordance with JIS material standards) are more preferably used due to having satisfactory lightweight properties (for example, specific gravity at room temperature: 2.5 to 2.8), being relatively cheap, and being easily formed into a complex shape.

Moreover, aluminum or aluminum alloys are characterized in that due to a high thermal conductivity (for example, 230 to 240 W/(m·° C.) at room temperature) and a low specific heat (for example, 230 to 240 W/(m·° C.) at room temperature), aluminum or aluminum alloys tend to reach a temperature (for example, 20 to 25° C.) suitable for the human skin during treatment.

Therefore, with the health instrument 1 made of aluminum or aluminum alloys as a formation material, it is possible to obtain an advantage that satisfactory comfortableness is provided to a treatment subject and a burden is unlikely to be imposed thereon.

In addition, among metallic materials, titanium or titanium alloys are also preferably used due to being highly hypoallergenic to the human body, having a high hardness (HV hardness is around 110 to 300), having relatively satisfactory lightweight properties (for example, specific gravity at room temperature: 4.1 to 4.5), having a high durability, and being easily usable in the treatment of the human body.

Examples of titanium and titanium alloys described above include JIS type 1, JIS type 2, JIS type 60 and JIS type 61 which are high strength alloys, and JIS type 11, JIS type 12, and the like which are corrosion resistant alloys, which are made in accordance with JIS material standards.

Moreover, with titanium and titanium alloys, it is possible to obtain an advantage that due to being highly resistant to corrosion, adhesive matter such as surface contaminants are easily removable and also long-term storability is satisfactory.

On the other hand, compared to metallic materials, due to being much lightweight, being more outstandingly processable into a complex shape, being more outstandingly economical (cheap), and the like, resin materials are also preferably used.

If resin materials are used and are mixed with a predetermined filler or reinforcing fiber, while having the same mechanical strengths as those of metallic materials, the resin materials are capable of maintaining satisfactory lightweight properties or processing-ability.

Therefore, it is possible to improve a decorative appearance by exhibiting coloring effects or the like.

Here, main compositions of the resin materials include at least one of ABS resin, phenol resin, epoxy resin, urethane resin, silicone resin, polyester resin, polycarbonate resin, olefin resin, hydrocarbon resin, and the like.

In addition, examples of the predetermined filler include silica, titanium oxide, aluminum oxide, magnesium oxide, calcium carbonate, magnesium hydride, metallic magnesium, metallic titanium, and carbon filler which have, for example, a mean particle diameter of 0.01 to 100 μm.

In addition, examples of the predetermined reinforcing fiber include a carbon fiber, a glass fiber, and an olefin fiber which have, for example, an average length of 0.1 to 3 mm.

Then, the amount of mixture of the predetermined filer or the predetermined reinforcing fiber is dependent on the type thereof, the types of the main compositions of the resin materials, or the durability, application, or the like of the health instrument; however, typically, the amount of mixture is preferably a value within the range of 0.1 to 80 parts by weight with respect to 100 parts by weight of the main compositions of the resin materials.

The reason is that if the amount of mixture of the predetermined filler or the predetermined reinforcing fiber is a value within the range described above, the health instrument is capable of having satisfactory mechanical strength and maintaining lightweight properties (predetermined weight) which provide good handling-ability and carrying-ability.

Therefore, the amount of mixture of the predetermined filler or the predetermined reinforcing fiber is more preferably a value within the range of 1 to 60 parts by weight with respect to 100 parts by weight of the main compositions of the resin materials, and further preferably a value within the range of 10 to 50 parts by weight.

Moreover, if a magnetic material such as neodymium, samarium, cobalt, zirconium, or ferrite is mixed as a portion of the formation material, the health instrument 1 is further magnetized after formed into a predetermined shape, and thus the health instrument 1 may become also a magnetic health instrument.

If the health instrument 1 is a magnetic health instrument as described above, when the health instrument 1 is brought into contact with the skin of the human body, blood circulation may be stimulated by magnetism, and it is possible to obtain more satisfactory and prompt treatment effects.

Then, the amount of mixture of the magnetic material is dependent on the type of the magnetic material, the types of the main compositions of the resin materials, or the durability, application, or the like of the health instrument; however, typically, the amount of mixture is preferably a value within the range of 0.1 to 10 parts by weight with respect to 100 parts by weight of the main compositions of the resin materials.

The reason is that if the amount of mixture of the magnetic material is a value within the range described above, the health instrument 1 can be magnetized to such extent that the magnetism does not excessively affect the human body, and is capable of maintaining lightweight properties (predetermined weight) which provide good handling-ability and carrying-ability.

Therefore, the amount of mixture of the magnetic material is more preferably a value within the range of 0.5 to 8 parts by weight with respect to 100 parts by weight of the main compositions of the resin materials, and further preferably a value within the range of 1 to 5 parts by weight.

Incidentally, the health instrument 1 illustrated in FIGS. 1A to 1D and the like may have a configuration where one or more the grip portions 11*a* and 11*b* and the treatment portion 10 are made of the same material, or may have a configuration where both are made of different materials; however, if the health instrument 1 has a joint portion between the grip portions 11*a* and 11*b* and the treatment portion 10, the joint portion has preferably a smooth surface free from gaps or burrs.

The reason is that with the configuration described above, it is possible to effectively prevent a laceration or the like to a lesion site, which is induced by the joint portion during treatment, and it is possible to perform a treatment more smoothly and safely.

(2) Overall Length

An overall length (L1) of the health instrument 1 illustrated in FIGS. 1A to 1D and the like is not particularly limited; however, it is preferable that the overall length (L1) is a length with which when the body type or the like of a general treatment subject is taken into consideration, the health instrument 1 can be suitably used in treatment, and a length with which good handling-ability and carrying-ability is maintained.

More specifically, the overall length (L1) is preferably a value within the range of 30 to 55 cm, more preferably a value within the range of 33 to 50 cm, and further preferably a value within the range of 35 to 45 cm.

2. Treatment Portion (1) Shape

In addition, the shape of the treatment portion 10 is characterized in that as exemplarily illustrated in FIGS. 1A to 1D and the like, the treatment portion 10 extends from at least one or more grip portions 11*a* and 11*b* along the length direction and the curved portion 20 is formed in the width direction.

The reason is that with the configuration described above, when performing a treatment using the treatment portion 10, it is possible to more efficiently obtain treatment effects.

The reason is that since a large number of human body regions have a rounded surface shape, a concave portion of the curved portion 20 in the width direction described above can be suitably brought into wide contact with the human body regions.

In addition, the reason is that it is possible to reduce a contact surface between the health instrument 1 and a lesion site, and when requiring a large pressing force or the like, it is possible to exert a larger pressing force by using a convex portion of the curved portion 20 in the width direction.

A bottom of the curved portion 20 of the treatment portion 10 has a convex section and two concave sections between the convex section and the grip portions 11*a* and between the convex section and the grip portions 11*b*. The grip portions 11*a* and the grip portions 11*b* are angled upward when the convex section is directed upward.

In addition, right and left cut segments, which are made when cutting the treatment portion 10 along the line A-A' passing through the midpoints along the length direction, are preferably asymmetrical in shape.

With the configuration described above, there is an increase in the number of the protrusions, the curved surfaces, or the like which have different shapes as portions usable in treatment, and thus it is possible to perform treatments to cope with more variety of human body regions.

Namely, since the shapes on the right and left of the line A-A' described above which passes through the midpoints are different from each other, it is possible to have ten or more different shapes of portions as portions usable in treatment.

Therefore, by using the shapes properly, it is possible to perform a wide variety of treatments to cope with a difference in the state and shape of a soft tissue such as a fascia or a muscle, which is induced by a difference in physique or constitution between treatment subjects.

(2) Cross-Sectional Shape

Figure 1B:
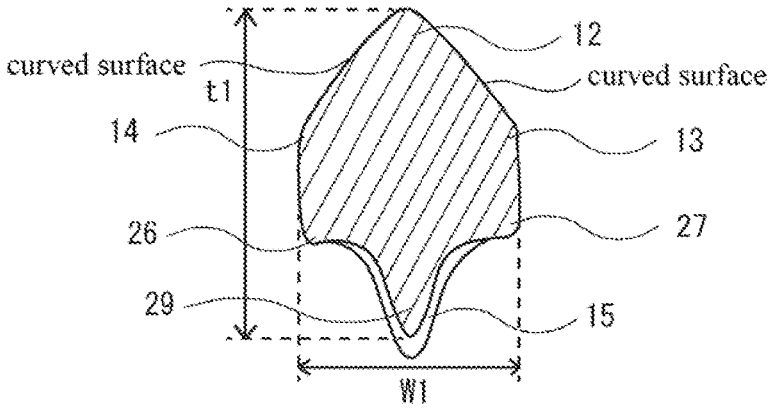
Figure 1C:
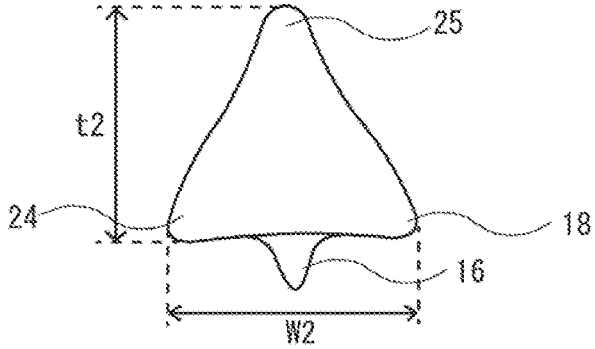
Figure 1D:
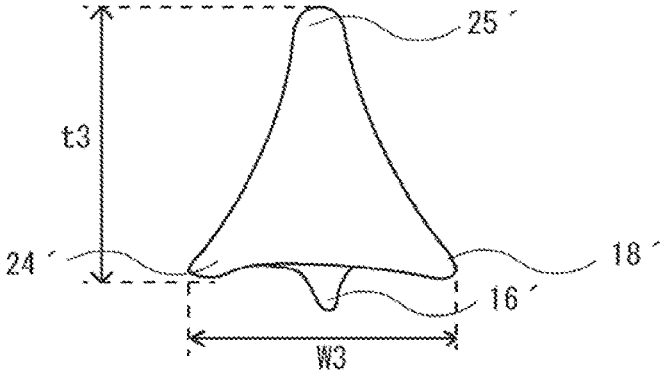
Figure 2:
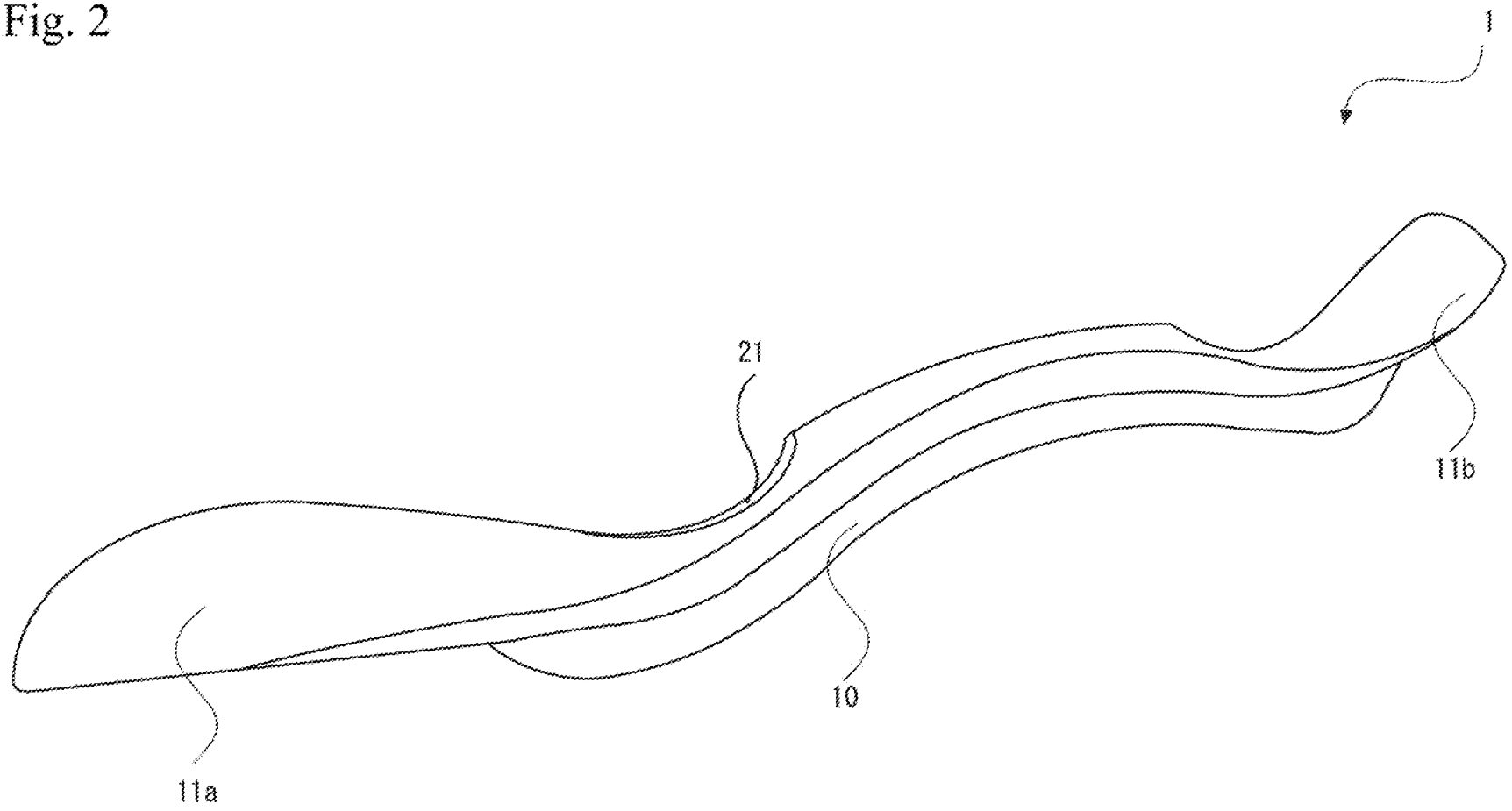
FIG. 2 is a perspective view provided to describe the health instrument according to the invention.

The health instrument 1 in the first embodiment is characterized in that in the cross-sectional shape which is obtained when cutting the treatment portion 10 along the line A-A' passing through the midpoints along the length direction, as illustrated in FIG. 1B, the treatment portion 10 has four or more protrusions on the surface and the tip portions of the protrusions have curved shapes.

The reason is that with the configuration described above, it is possible to suitably use the protrusions of the treatment portion 10 in treatment, and it is possible to efficiently obtain treatment effects.

The reason is that tips of the protrusions of the treatment portion 10 are curved and it is possible to perform a treatment while exerting an adequate pressing force onto a lesion site.

Incidentally, in this embodiment, the curving of the tip portion of the protrusion implies that the tip portion of the protrusion is flat, has an inward concave shape, or has a shape which is rounded and protrudes convexly.

Therefore, more specifically, the radius of curvature of the tip portion of the protrusion has preferably typically a value within the range of 0.01 to 1,000 μm, more preferably a value within the range of 0.05 to 900 μm, and further preferably a value within the range of 0.1 to 800 μm.

In addition, when four or more protrusions described above include at least a first protrusion 12, a second protrusion 13, and a third protrusion 14, the longest protrusion among four or more protrusions is the first protrusion 12, and protrusions adjacent on right and left sides are the second protrusion 13 and the third protrusion 14, both or either one of a surface between the first protrusion 12 and the second protrusion 13 and a surface between the first protrusion 12 and the third protrusion 14 also preferably are smooth curved surfaces.

As described above, since not only a plurality of the protrusions but also the smooth curved surfaces are provided, it is possible to also rub against a human soft tissue such as a fascia or a muscle. Moreover, in performing a wide variety of treatments, it is possible to properly perform a treatment also on a region not suitable for treatment by exerting a large pressing force.

Incidentally, the length of a protrusion implies the longest length, for example, in a cross-sectional shape which is obtained when assuming a predetermined plane including straight lines including a line connecting two protrusions adjacent on the right and left of the protrusion which is a measurement subject, and drawing a straight line in a normal direction from the predetermined plane to an apex of the protrusion which is the measurement subject.

Moreover, when four or more protrusions described above further include a fourth protrusion 27, a fifth protrusion 26, and a sixth protrusion 29, a protrusion adjacent to the second protrusion 13 is the fourth protrusion 27, a protrusion adjacent to the third protrusion 14 is the fifth protrusion 26, and a protrusion positioned between the fourth protrusion 27 and the fifth protrusion 26 is the sixth protrusion 29, it is preferable that both or either one of a surface between the fourth protrusion 27 and the sixth protrusion 29 and a surface between the fifth protrusion 26 and the sixth protrusion 29 are curved surfaces which are concave inward in the cross-sectional shape, and the surfaces are rough surfaces 15.

The reason is that when using, for example, a massage oil (essential oil or the like) or a massage wax (including cream or the like) in the treatment of the human body, it is possible to evenly distribute the massage oil or wax, and to increase also a force to hold the massage oil or wax using the rough surfaces 15 along the length direction of the treatment portion 10.

More specifically, when using a massage oil or wax in treatment such as massage, typically, a treating person is capable of applying the massage oil or wax to a subject by coating his/her own palm or the like with the massage oil or wax and bring the palm into contact with a lesion site.

Alternatively, a technique is used in which the treating person widely applies a massage oil or wax around a lesion site by applying a proper amount of the massage oil or wax to the vicinity of the lesion site, and then touching the massage oil or wax with his/her own hand.

However, if the configuration described above is adopted, since the massage oil or wax spreads along the length direction of the treatment portion 10, it is possible to distribute the massage oil or wax over the entirety of the rough surface 15 of the curved surface which is concave inward in the cross-sectional shape.

Therefore, it is possible to widely apply the massage oil or wax evenly over a wide area by bringing the treatment portion 10 into contact with the lesion site in this state and performing a treatment.

(3) Length

When the treatment portion 10 is used in treatment, a length (L3) of the treatment portion 10 illustrated in FIGS. 1A to 1D is preferably typically a value within the range of 15 to 45 cm.

The reason is that when a subject is a relatively large body region such as the back or the femoral region, this length facilitates suitable contact with the subject, and since this length lowers the possibility of an occurrence of extra portions not used in treatment, it is possible to prevent an excess weight increase or the like.

Therefore, more specifically, the length (L3) of the treatment portion 10 is more preferably a value within the range of 18 to 40 cm, and further preferably a value within the range of 20 to 35 cm.

(4) Width

A width (W1) of the treatment portion 10 illustrated in FIGS. 1A to 1D is preferably typically a value within the range of 1.5 to 5 cm.

The reason is that if the width is a value within the range described above, it becomes easy to form the configuration having four or more protrusions in the cross-sectional shape described above, and it is possible to maintain an ability to cope with a wide variety of treatments or to maintain good handling-ability and carrying-ability by preventing an excessive weight increase.

Therefore, more specifically, the width (W1) of the treatment portion 10 is more preferably a value within the range of 1.8 to 4.5 cm, and further preferably a value within the range of 2 to 4 cm.

(5) Height

A height (t1) of the treatment portion 10 illustrated in FIGS. 1A to 1D is preferably typically a value within the range of 2 to 5.5 cm.

The reason is that if the height is a value within the range described above, it becomes easy to form the configuration having four or more protrusions in the cross-sectional shape described above, and it is possible to cope with a wide variety of treatments by preventing a portion of the protrusions from being excessively sharply formed.

Therefore, more specifically, the height (t1) of the treatment portion 10 is more preferably a value within the range of 2.3 to 5 cm, and further preferably a value within the range of 2.5 to 4.5 cm.

3. Grip Portion (1) Shape

Figure 3A:
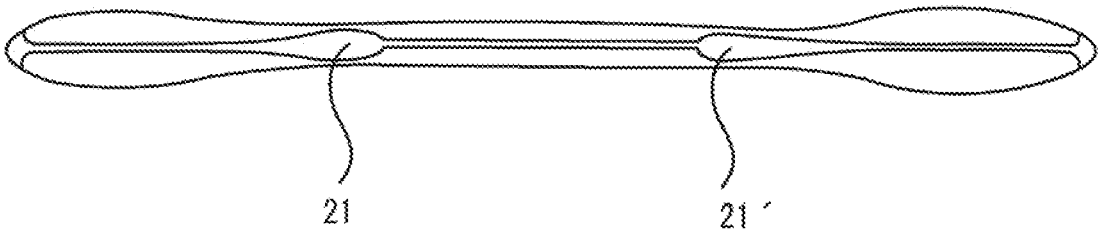
FIGS. 3A and 3B are views provided to describe the health instrument according to the invention
Figure 3B:
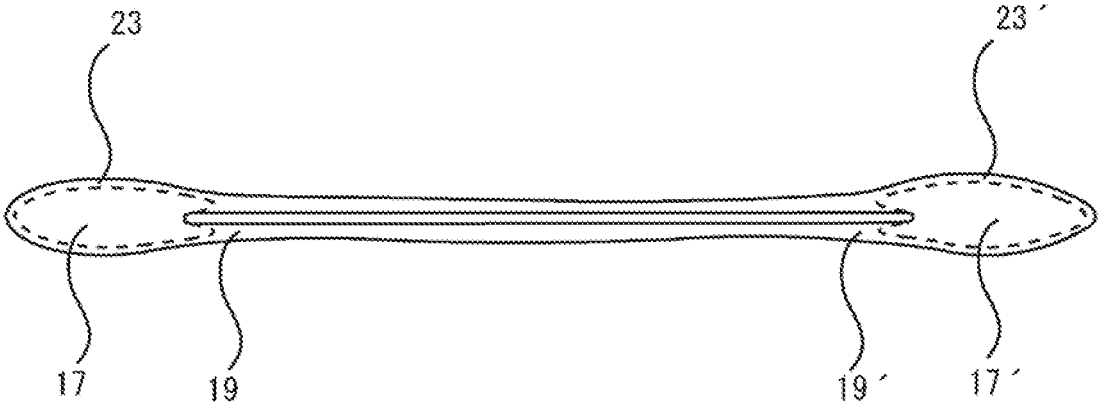

In the shape of at least one or more grip portions 11*a* and 11*b*, as illustrated in FIG. 3B, a spoon-shaped concave portion 17 or 17' and an edge 23 or 23' are preferably provided at least on one side.

The reason is that it is possible to bring the health instrument into contact with a small human body region such as the fingertip or the neck, or to effectively perform rubbing by using the spoon-shaped concave portions 17 and 17', the edges 23 and 23', the tip portions, or the like.

In addition, when performing a treatment in a state of gripping at least one or more grip portions 11*a* and 11*b*, it is possible to grip, in a holding manner, the spoon-shaped concave portions 17 and 17' and the edges 23 and 23' described above.

Moreover, it is possible to tightly wrap a cloth, string, or the like around at least one or more grip portions 11*a* and 11*b*, and thus it is possible to improve usability of the health instrument 1.

In addition, if the health instrument 1 has two grip portions 11*a* and 11*b*, and in the shapes of two grip portions 11*a* and 11*b*, the spoon-shaped concave portions 17 and 17' and the edges 23 and 23' are provided on both sides, two grip portions 11*a* and 11*b* preferably differ from each other in both or either one of the sizes and shapes of the spoon-shaped concave portions 17 and 17' and the edges 23 and 23'.

The reason is that when bringing two grip portions 11*a* and 11*b* into contact with the human body and performing a treatment, if two grip portions 11*a* and 11*b* differ from each other in both or either one of the sizes and shapes of the spoon-shaped concave portions 17 and 17' and the edges 23 and 23', since there occurs a difference in shape where suitable contact is attainable, it is possible to properly use two grip portions 11*a* and 11*b* to cope with individual differences in soft tissue such as a fascia or a muscle, which are induced by a difference in lesion site, a difference in physique between treatment subjects, or the like.

(2) Communication Portion

If at least one or more grip portions 11*a* and 11*b* have the spoon-shaped concave portions 17 and 17' and the edges 23 and 23', communication portions 19 and 19' are preferably provided between the spoon-shaped concave portions 17 and 17' and the second protrusion 13 and the third protrusion 14 in the cross-sectional shape of the treatment portion 10, and between the spoon-shaped concave portions 17 and 17' and the curved surfaces which are concave inward in the cross-sectional shape.

With the configuration described above, it is possible to apply a proper amount of a massage oil toward the treatment portion 10 only by holding the massage oil or a massage wax in the spoon-shaped concave portions 17 and 17'.

The reason is that namely, since the spoon-shaped concave portions 17 and 17' serve as receivers, a proper amount of the massage oil or the massage wax (wax-like horse oil or the like) is capable of spreading toward the treatment portion 10 via the communication portions 19 and 19', and it is possible to more efficiently perform a treatment using the massage oil or the massage wax.

Incidentally, as described above, from the viewpoint that the spoon-shaped concave portions 17 and 17' serve as receivers and the massage oil or the massage wax spreads toward the treatment portion 10 via the communication portions 19 and 19', it is preferable that the spoon-shaped concave portions 17 and 17', the communication portions 19 and 19', and the curved surfaces which are concave inward in the cross-sectional shape of the treatment portion 10 are provided in the same surface of the health instrument 1, and are connected to each other without steps therebetween.

With the configuration described above, the massage oil, the massage wax, or the like is capable of more smoothly spreading in the health instrument 1.

(3) Press Portion

Moreover, as illustrated in FIG. 3A, press portions 21 and 21' which are curved inward are preferably provided between at least one or more grip portions 11*a* and 11*b* and the treatment portion 10.

The reason is that with the configuration described above, it is possible to efficiently perform a treatment with a stronger pressing force over a long period of time by pressing the fingers or the like against the press portions 21 and 21' which are curved inward of the health instrument 1 with a rod shape, namely, are curved inward from an outer surface.

The reason is that more specifically, when gripping at least one or more grip portions 11*a* and 11*b*, it becomes easy to bring the treatment portion 10 into contact with a lesion site, and it becomes easy to exert a load in a pushing direction by bring the fingers or the like into contact with the press portions 21 and 21'.

Here, a surface including the press portions 21 and 21' is not particularly limited; however, if the press portions 21 and 21' are provided on a side having the communication portions 19 and 19', a massage oil may not spread smoothly.

For this reason, the press portions 21 and 21' are preferably provided between at least one or more grip portions 11*a* and 11*b* and the treatment portion 10 and on a side, which does not have the communication portions 19 and 19'.

(4) Length

Lengths (L2 and L4) of at least one or more grip portions 11*a* and 11*b* are preferably typically values within the range of 5 to 10 cm.

The reason is that if the lengths are values within the range described above, it is possible to suitably grip the health instrument 1, it is possible to prevent an increase in the overall weight, the overall length, and the like of the health instrument 1, which is induced by an occurrence of extra portions not in use, and it is possible to maintain handling-ability and carrying-ability within a satisfactory range.

Therefore, more specifically, the lengths (L2 and L4) of at least one or more grip portions 11*a* and 11*b* are more preferably values within the range of 5.5 to 9.5 cm, and further preferably values within the range of 6 to 9 cm.

(5) Width

Widths (W2 and W3) of at least one or more grip portions 11*a* and 11*b* illustrated in FIGS. 1A to 1D are preferably typically values within the range of 2 to 6 cm.

The reason is that if the widths are values within the range described above, it becomes easy to form the spoon-shaped concave portions 17 and 17' and the edges 23 and 23', and it becomes easy to perform a treatment on a small human body region due to being easy to suitably grip at least one or more grip portions 11*a* and 11*b*.

Therefore, more specifically, the widths (W2 and W3) of at least one or more grip portions 11*a* and 11*b* are more preferably values within the range of 2.3 to 5.5 cm, and further preferably values within the range of 2.5 to 5 cm.

(6) Height

Heights (t2 and t3) of two grip portions 11*a* and 11*b* exemplarily illustrated in FIGS. 1A to 1D are preferably typically values within the range of 2.5 to 6 cm.

The reason is that if the heights are values within the range described above, it becomes easy to maintain a predetermined strength, and it becomes easy to perform a treatment on a small human body region due to being easy to suitably grip at least one or more grip portions 11*a* and 11*b*.

Therefore, more specifically, the heights (t2 and t3) of at least one or more grip portions 11*a* and 11*b* are more preferably values within the range of 2.8 to 5.5 cm, and further preferably values within the range of 3 to 5 cm.

4. Manufacturing Method

In addition, a method for manufacturing the health instrument is not particularly limited, and preferably includes at least three steps such as a preparation step, a forming step, and a finishing step illustrated hereinafter.

(1) Preparation Step

The preparation step is a step of preparing a formation material of the health instrument, which is formed of at least one of a metallic material, a ceramic material, a woody material, and a resin material.

Incidentally, as partially described above, in the health instrument 1 exemplarily illustrated in FIGS. 1A to 1D, the treatment portion 10 and at least one or more grip portions 11*a* and 11*b* may be made of the same material, or may be made of different materials, and correspondingly, the formation material may be prepared.

(2) Forming Step

The forming step is a step of forming the material, which is prepared in the preparation step, into the health instrument 1 with a rod shape which has, as illustrated in FIGS. 1A to 1D, at least one or more grip portions 11*a* and 11*b* and the treatment portion 10 therebetween.

Then, more specifically, the forming step is a step of forming the health instrument 1 with a rod shape in which the treatment portion 10 has the curved portion 20 in the width direction, the cross-sectional shape taken at the midpoint A along the length direction of the treatment portion 10 has four or more protrusions on the periphery of the cross section, and the tip portions of the protrusions are curved.

Here, a forming method adopted in the forming step is not particularly limited; however, the forming method preferably is, for example, a method in response to the formation material.

Therefore, it is possible to suitably use casting if the formation material is a metallic material or a ceramic material, and an injection molding method or the like if the formation material is a resin material.

(3) Finishing Step

The finishing step is a step of bringing a rod-shaped member, which is formed in the forming step, into a state of being usable as a product by removing portions unnecessary in a final shape or performing a polishing process or the like.

A method used in the finishing step is not particularly limited; however, if a metallic material is used, it is possible to smooth a surface by using a lathing process, a grinding process, or the like.

A chemical etching process or the like is preferably used in the formation of the rough surface 15.

5. Method of Use

A method for using the health instrument 1 illustrated in FIGS. 1A to 1D and the like is not particularly limited, and preferably includes at least two steps, for example, a preparation step and a treatment step.

(1) Preparation Step

The preparation step is a step of preparing the health instrument 1 to be used in treatment which is illustrated in FIGS. 1A to 1D and the like.

In treatment, basically, a treatment subject performs a treatment on his/her own; however, if a subject is a region such as the back which is hard for the hand to reach, in order to more efficiently obtain treatment effects, the treatment subject preferably also receives a treatment from a treating person separate from the treatment subject.

(2) Treatment Step

The treatment step is a step of restoring a fascia, a muscle, or the like into a normal state by bringing a large number of the protrusions or the like of the health instrument 1 illustrated in FIGS. 1A to 1D and the like into contact with a lesion site of the treatment subject, and rubbing thereagainst while pressing thereagainst.

More specifically, the treatment step is a step of restoring a soft tissue into a normal state by improving a disorder of the soft tissue such as a fascia or a muscle by bringing the first protrusion 12 or the like of the health instrument 1 into contact with the lesion site of the treatment subject, and rubbing thereagainst while pressing thereagainst to such extent that it is possible to see a concave region 28 around the lesion site.

Figure 4A:
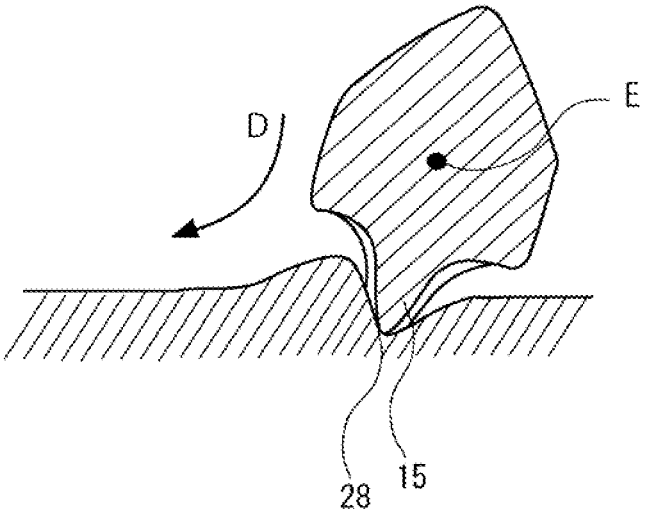
FIGS. 4A and 4B are views provided to describe a method for using the health instrument according to the invention, and are cross-sectional views when the health instrument is used in a state where the treatment portion is brought into contact with a lesion site.
Figure 4B:
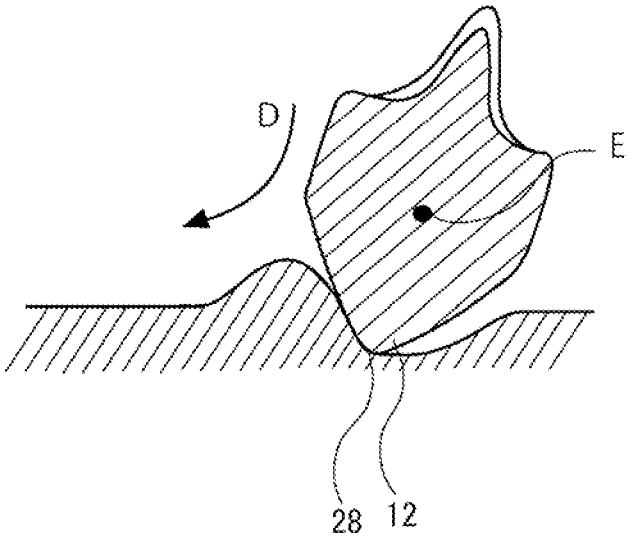
Figure 5A:
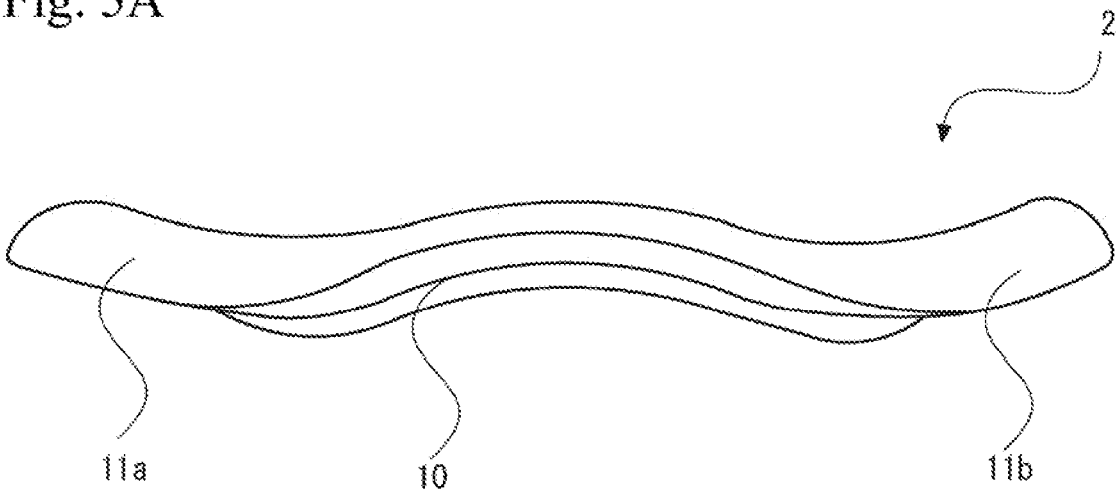
FIGS. 5A to 5C are other views provided to describe the health instrument according to the invention
Figure 5B:
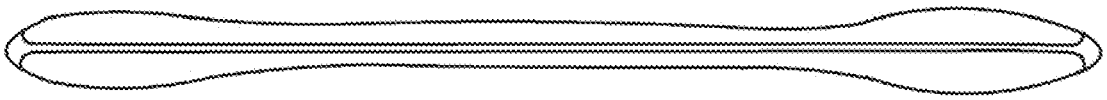
Figure 5C:
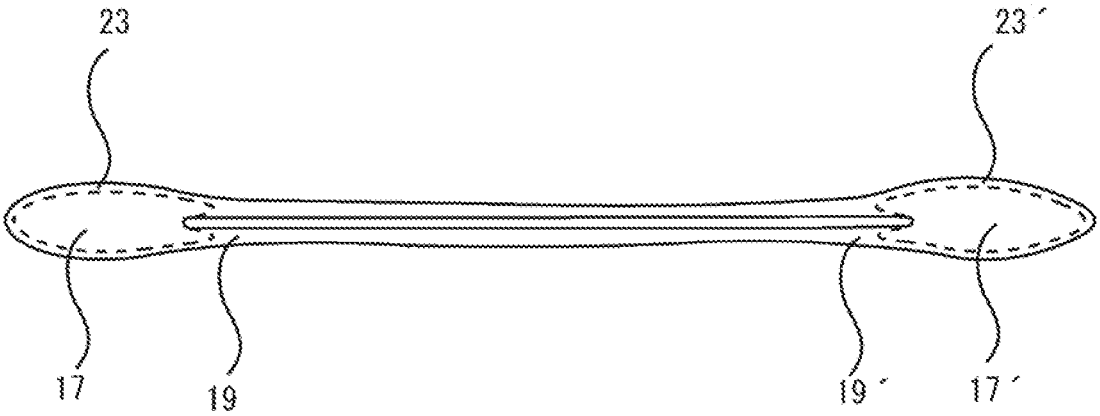

Incidentally, as illustrated in FIGS. 4A and 4B, according to the health instrument 1 illustrated in FIGS. 1A to 1D and the like, for example, it is possible to move the health instrument 1 while rotating the health instrument 1 around a center point E as an axis of the cross-sectional shape of the health instrument 1 in a direction of an arrow D, namely, to move the health instrument 1 along the skin surface while easily rotating the health instrument 1.

Therefore, compared to a case where the health instrument 1 is moved without rotation along the surface in the vicinity of the skin surface, it is possible to more effectively perform a treatment on a soft tissue such as a fascia or a muscle which is present in a deep site below the skin surface.

Moreover, since the health instrument 1 illustrated in FIGS. 1A to 1D and the like has a large number of the portions usable in treatment, it is also possible to locally press a lesion site of the treatment subject.

Therefore, it is possible to intensively perform a treatment also on a lesion site having a small area such as an area between the fingers, a phalangeal neck or the neck arounds.

It is preferable that a portion used in the treatment step is appropriately changed in response to the size or the shape of a lesion site or the physique or the physical state of the treatment subject. If the health instrument 1 illustrated in FIGS. 1A to 1D is referenced, examples of the usable portion include the first protrusion 12, the second protrusion 13, the third protrusion 14, and the protrusions 26 and 27 in the cross-sectional shape of the treatment portion 10.

Moreover, it is possible to use also at least one or more grip portions 11*a* and 11*b*, the edges 23 and 23', protrusions 18, 18', 24, 24', 25, and 25', or the like. Even if the cross-sectional shape of the treatment portion 10 has four protrusions, a variety of portions, namely, at least ten or more portions are usable in treatment.

The reason is that it is possible to accurately bring the health instrument 1 into contact with a lesion site, and it is possible to more efficiently obtain treatment effects by using a portion with a suitable shape in the health instrument 1 illustrated in FIGS. 1A to 1D and the like for each lesion site which is a subject.

Incidentally, it is also preferable that a pressing force in treatment is appropriately regulated in response to the constitution, the physical state, or the like of the treatment subject.

Namely, it is preferable that a correlation between the amount of intrusion of a protrusion into a muscle and the pressing force is measured in advance with an optical microscope, a caliper, or moreover a pressure gauge, or the like, and a treatment is also performed based thereon.

Then, in the treatment step, in a state where the treatment subject puts on clothes, a treatment may be performed thereon from above the clothes; however, a treatment may be more preferably performed in a state where a lesion site is exposed.

The reason is that if performing a treatment while bringing the health instrument 1 into direct contact with the lesion site, it may be able to perceive an internal state of the body, and the possibility of performing an accurate treatment in response to the state becomes high.

Moreover, if a treatment is performed in a state where a lesion site is exposed, since a load to the skin induced by friction is reduced or skin penetration effects are exhibited, a treatment using a massage oil or a massage wax is also preferably performed.

Namely, it is possible to apply an almond oil or a grape-seed oil as a massage oil, and a horse oil, a jojoba oil, or the like as a massage wax to predetermined places on the health instrument. Then, since the massage oil and the massage wax spread from the spoon-shaped concave portions 17 and 17' to the rough surface 15 via the communication portions 19 and 19', it is possible to cause the massage oil or wax to penetrate the skin while performing a treatment, and it is possible to improve slipperiness between the health instrument 1 and the lesion site or the like, and to enhance treatment effects.

EXAMPLES

Hereinafter, the invention will be further described in detail using examples.

However, the invention is not limited to the descriptions of the following examples without particular reasons.

Example 1

1. Preparation of Health Instrument

(1) Basic Forming

A rod-shaped member, which had two grip portions 11*a* and 11*b*, the treatment portion 10 having the curved portion 20 therebetween in the width direction, six protrusions 12, 13, 14, 26, 27, and 29, and the rough surface 15 in a cross-sectional shape taken at a midpoint in the width direction, was formed in accordance with FIGS. 1A to 1D by injecting aluminum (pure aluminum) as a formation material into a predetermined mold by a sand casting method.

Both of two grip portions 11*a* and 11*b* of the formed rod-shaped member had the spoon-shaped concave portions 17 and 17' and the edges 23 and 23'. Moreover, when the rod-shaped member was cut at the midpoint along the length direction, right and left cut segments were asymmetrical in shape.

(2) Finishing

A lathing process and a grinding process were performed on the formed rod-shaped member to provide the press portion between the grip portion and the treatment portion and on a protruding side of the curved portion in the width direction of the treatment portion, and to smooth the surface free from burrs and the like.

Moreover, an etching process was performed to form the rough surface in the spoon-shaped concave portions of the grip portions, the communication portions, and the curved surface between the second protrusion and the third protrusion of the treatment portion.

A mixed acid aluminum etching solution (manufactured by KANTO CHEMICAL CO., INC.) was used as an etching solution, and after the process, washing was performed to produce a health instrument having a weight of 300 g.

2. Evaluation of Health Instrument

(1) Carrying-Ability

The carrying-ability of the health instrument which is obtained by a treatment subject before and after treatment was evaluated in accordance with the following criteria. Table 1 shows obtained results.

Incidentally, if the weight of the health instrument was less than or equal to 1 kg, it was possible to suitably grip the health instrument, and it was easy to carry the health instrument.

⊙ (Very Good): The weight is less than or equal to 500 g.
O (Good): The weight is less than or equal to 1 kg.
Δ (Fair): The weight is less than or equal to 2 kg.
x (Bad): The weight exceeds 2 kg.

(2) Sense of Use

The treatment subject performed a treatment on eight regions such as his/her back, femoral region, lower leg region, arm, shoulder, neck, fingertip, and toe for 30 minutes on his/her own.

After the treatment, the usability of the health instrument illustrated in FIGS. 1A to 1D was evaluated in accordance with the following criteria. Table 1 shows obtained results.

⊙(Very Good): In performing a treatment on his/her own, it is possible to perform a treatment by bringing the health instrument into contact with all of eight regions, and properly pressing, rotating, and moving the health instrument or pressing the health instrument against a small region very precisely.

O (Good): In performing a treatment on his/her own, it is possible to perform a treatment by bringing the health instrument into contact with six or more regions, and properly pressing, rotating, and moving the health instrument or pressing the health instrument against a small region very precisely.

Δ(Fair): In performing a treatment on his/her own, it is possible to perform a treatment by bringing the health instrument into contact with four or more regions, and properly pressing, rotating, and moving the health instrument or pressing the health instrument against a small region very precisely.

x (Bad): In performing a treatment on his/her own, it is possible to perform a treatment by bringing the health instrument into contact with less than four regions, and properly pressing, rotating, and moving the health instrument or pressing the health instrument against a small region very precisely.

Example 2

In Example 2, except that an aluminum alloy (A3003 in JIS material standards) was used as a formation material, and a surface was coated with a predetermined amount of a wax-like horse oil (approximately 1 g), the same health instrument as that in Example 1 was produced, and the usability and the like were evaluated. Table 1 shows obtained results.

Example 3

In Example 3, except that a stainless steel (SUS 304, specific gravity: 7.9, HV hardness: 180, and thermal conductivity: 16 to 25 W/(m·° C.)) was used as a formation material, the same health instrument as that in Example 1 was produced, and the usability and the like were evaluated. Table 1 shows obtained results.

Example 4

Figure 6A:
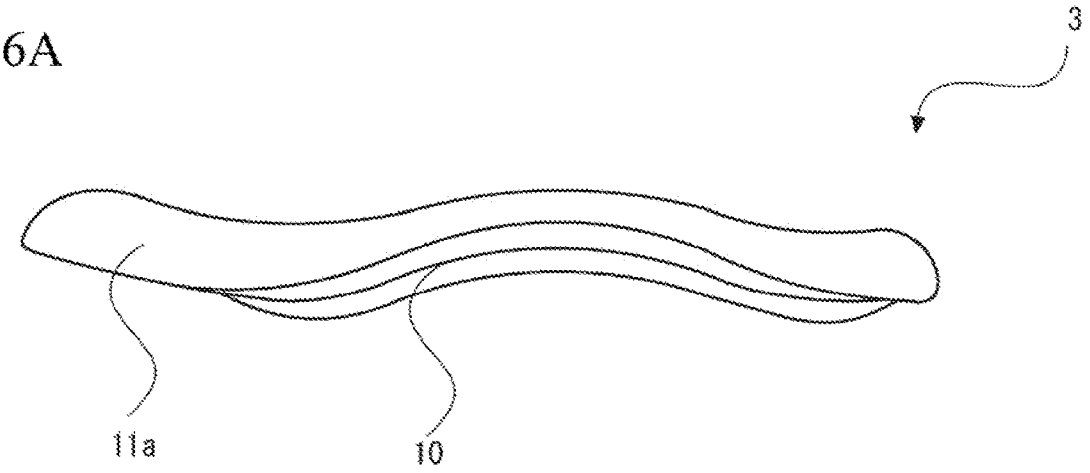
FIGS. 6A to 6C are further other views provided to describe the health instrument according to the invention
Figure 6B:
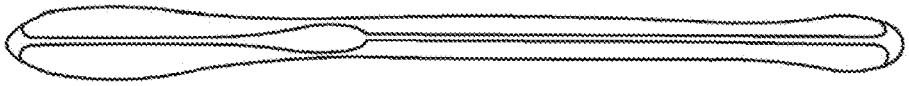
Figure 6C:
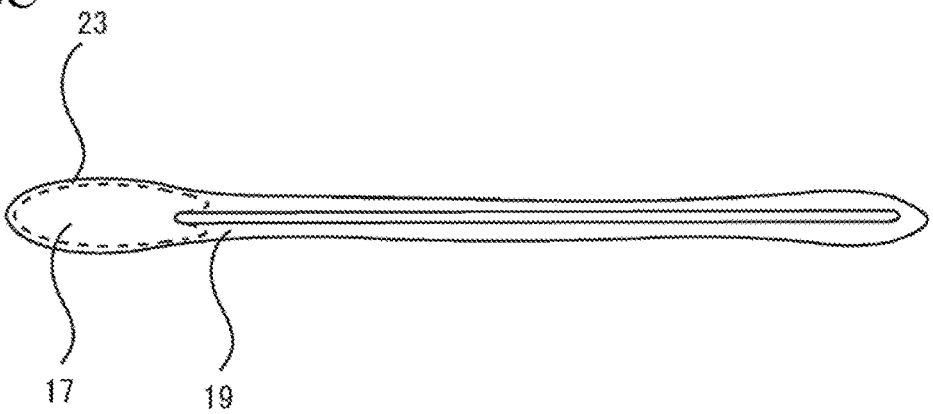

In Example 4, except that as illustrated in FIGS. 6A to 6C, the health instrument was formed without the press portion provided, the same health instrument as that in Example 1 was produced, and the usability and the like were evaluated. Table 1 shows obtained results.

Example 5

Figure 7A:
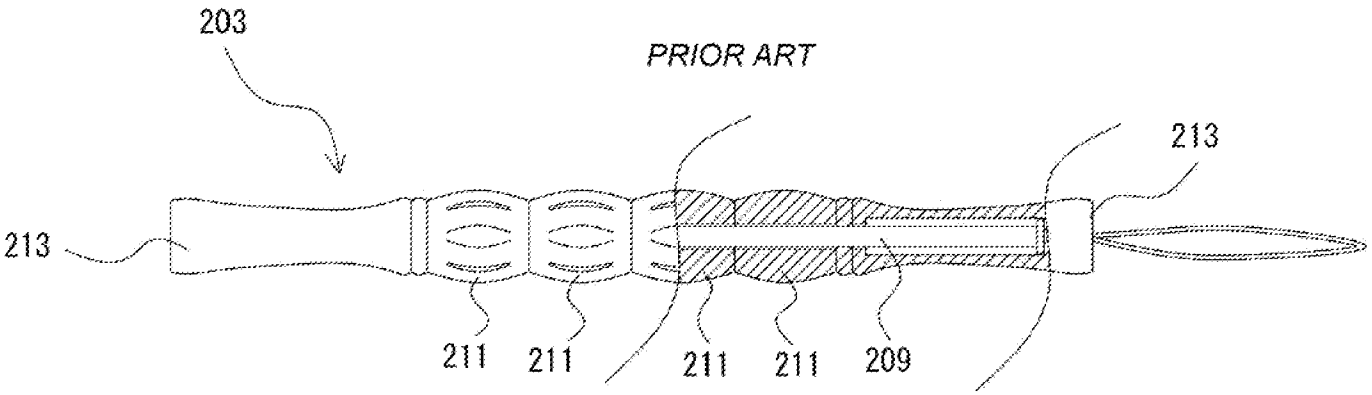
FIGS. 7A and 7B are views provided to describe a multilayer rod-shaped health instrument in the related art.
Figure 7B:
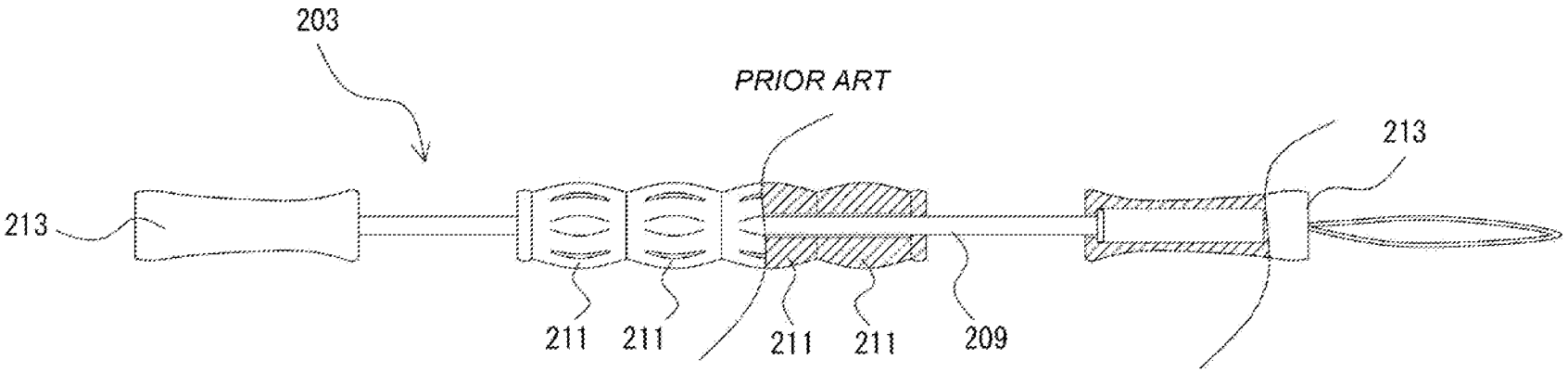

In Example 5, except that one grip portion was provided as illustrated in FIGS. 7A and 7B, the same health instrument as that in Example 1 was produced, and the usability and the like were evaluated. Table 1 shows obtained results.

Example 6

In Example 6, except that titanium was used as a formation material, the same health instrument as that in Example 1 was produced, and the usability and the like were evaluated. Table 1 shows obtained results.

Incidentally, when the allergic properties of the obtained health instrument were separately evaluated over another month, none of ten subjects showed an allergy.

Example 7

In Example 7, except that the health instrument was formed by mixing together 100 parts by weight of polybutylene terephthalate resin as a formation material, and 30 parts by weight of fine particulate silica having a mean particle diameter of 0.1 μm and 20 parts by weight of titanium oxide as fillers, and performing a heating process using a predetermined mold, the same health instrument as that in Example 1 was produced.

More specifically, the health instrument having the same external shape and dimensions as those in Example 1 was produced by filling the predetermined mold with the formation material, and melting and hardening the polybutylene terephthalate resin and the like by performing a heating process for 30 minutes with a mold temperature held at 200° C., and the usability and the like were evaluated. Table 1 shows obtained results.

Incidentally, when the weight of the obtained health instrument made of resin was measured, the weight was approximately 70 g.

Example 8

In Example 8, after the same health instrument as that in Example 1 was produced by mixing together ABS resin (acrylonitrile butadiene styrene copolymer) as a formation material, 20 parts by weight of silica having a mean particle diameter of 1 μm as a filler, and 10 parts by weight of neodymium as a rare earth magnetic material, the health instrument was further magnetized to have a magnetic strength of 0.2 Tesla.

Namely, except that the health instrument became a magnetic health instrument, the usability and the like were evaluated in the same manner as that in Example 1. Table 1 shows obtained results.

Incidentally, according to the magnetic health instrument of Example 8, the weight was approximately 100 g. Moreover, it was confirmed in a separate sensory test that the effect of reducing shoulder stiffness in a human body was significant due to magnet (eight of ten subjects experienced a reduction in shoulder stiffness after receiving a 30-minute treatment per day for one week).

Comparative Example 1

In Comparative Example 1, a multilayer rod-shaped health instrument in the related art illustrated in FIGS. 7A and 7B which had EPE (polyethylene foam) resin as a main composition was used, and the usability and the like were evaluated in accordance with the same criteria as those in Example 1. Table 1 shows obtained results.

Comparative Example 2

Figure 8A:
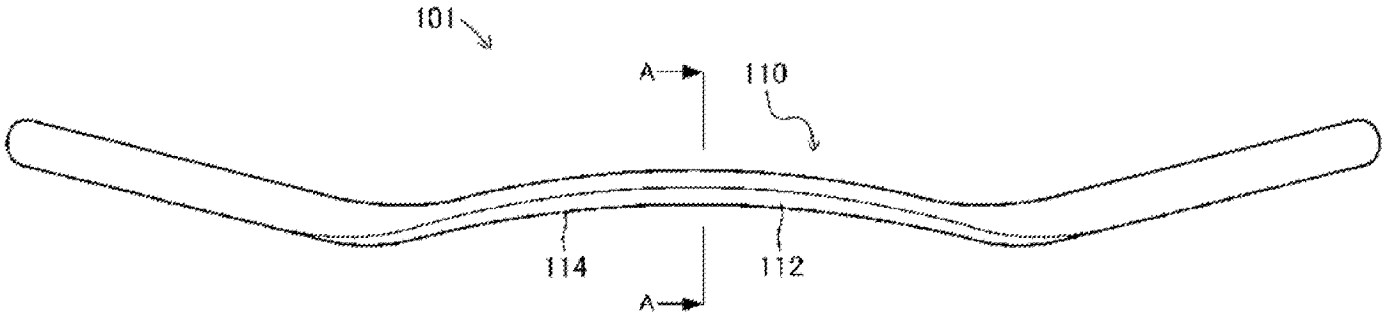
Fig. 8A PRIOR ART
FIGS. 8A and 8B are views provided to describe a soft tissue restoration aid instrument for humans in the related art.
Figure 8B:
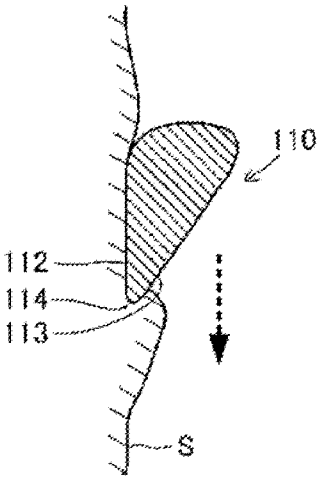
Fig. 8B PRIOR ART

In Comparative Example 2, a treatment was performed using a soft tissue restoration aid instrument for humans in the related art illustrated in FIGS. 8A and 8B, and using an almond oil as a massage oil, and the usability and the like were evaluated in accordance with the same criteria as those in Example 1. Table 1 shows obtained results.

Incidentally, in the case of Comparative Example 2, there was a problem that a treating person had to be prepared separately from a treatment subject in order to obtain stable treatment effects.

TABLE 1

| | Formation material | Press portion | Number of Grip portion | Carrying - ability | Sense of use |
|---|---|---|---|---|---|
| Example 1 | Aluminum | Provided | Two | ⊙ | ⊙ |
| Example 2 | Aluminum alloy | Provided | Two | ⊙ | ⊙ |
| Example 3 | Stainless steel | Provided | Two | ○ | ⊙ |
| Example 4 | Aluminum | Not provided | Two | ⊙ | ○ |
| Example 5 | Aluminum | Provided | One | ⊙ | ○ |
| Example 6 | Titanium | Provided | Two | ○ | ⊙ |
| Example 7 | Resin material + Filler | Provided | Two | ⊙ | ⊙ |
| Example 8 | Resin material + Filler + Magnetic material | Provided | Two | ⊙ | ⊙ |
| Comparative Example 1 | Resin material (EPE or the like) | — | — | ⊙ | X |
| Comparative Example 2 | Stainless steel | — | — | Δ | X |

※"—" implies a case where the corresponding portions are not provided or a case where it may not be determined whether or not the corresponding portions are provided.

INDUSTRIAL APPLICABILITY

As described above, according to the invention, there is provided a health instrument which properly copes with individual differences induced by a difference in physique or constitution to easily restore a human soft tissue such as a fascia or a muscle into a normal state by bringing the health instrument into contact with the human soft tissue on his/her own, and properly pressing, rotating, and moving the health instrument, pressing the health instrument against a small region very precisely, or the like.

Therefore, a wide versatility of use is anticipated to properly cope with individual physical states even though a treatment is performed by not only a professional treating person but also a treatment subject himself/herself.

Moreover, since the health instrument of the invention has predetermined protrusion portions, but basically has a rod shape, it is easy to carry or store the health instrument in a state of being inserted into a predetermined bag.

Furthermore, it is possible to obtain more outstanding lightweight properties and better carrying-ability by using aluminum, a resin material, or the like as a formation material of the health instrument.

The invention claimed is:

1. A health rod comprising:

a first end and a second end;

a first grip portion and a second grip portion provided at both ends of the health rod, the first grip portion and the second grip portion having a length of 5 to 10 cm; and a treatment portion extending along a length direction of the health rod between the first grip portion and the second grip portion, the treatment portion having a length of 15 to 45 cm, wherein the treatment portion has a curved portion in a width direction of the health rod, a bottom of the treatment portion in the length direction has a convex section and two concave sections between the convex section and the first grip portion and between the convex section and the second grip portion, the first grip portion and the second grip portion are angled upward when the convex section is directed upward, the treatment portion has four or more protrusions on a surface in a cross-sectional surface, which is obtained at a midpoint of the treatment portion in the length direction, the four or more protrusions include at least a first protrusion, a second protrusion and a third protrusion, a longest protrusion among the four or more protrusions is the first protrusion, protrusions adjacent on the first protrusion are the second protrusion and the third protrusion, one or both of a surface between the first protrusion and the second protrusion and a surface between the first protrusion and the third protrusion are curved surfaces having a smooth curve, and an overall length of the health rod is 30 to 55 cm, a width of the treatment portion is 1.5 to 5 cm, and a height of the treatment portion is 2 to 5.5 cm.

2. The health rod according to claim 1, wherein the four or more protrusions further include a fourth protrusion, a fifth protrusion and a sixth protrusion, a protrusion adjacent to the second protrusion is the fourth protrusion, a protrusion adjacent to the third protrusion is the fifth protrusion, and a protrusion positioned between the fourth protrusion and the fifth protrusion is the sixth protrusion, one or both of a surface between the fourth protrusion and the sixth protrusion and a surface between the fifth protrusion and the sixth protrusion are curved surfaces which are concave inward in the cross-sectional surface, and the curved surfaces are rough surfaces.

3. The health rod according to claim 1, wherein halves of the health rod on either side of the midpoint of the treatment portion in the length direction are asymmetrical in shape.

4. The health rod according to claim 1, wherein press portions which are curved inward from an outer surface are provided between the first grip portion and the treatment portion and between the second grip portion and the treatment portion.

5. The health rod according to claim 1, wherein at least one of the first grip portion and the second grip portion has a spoon-shaped concave portion and an edge.

6. The health rod according to claim 5, wherein a communication portion is provided between the spoon-shaped concave portion and the treatment portion.

7. The health rod according to claim 1, wherein the health rod is formed of at least one of a metallic material, a ceramic material, a woody material, and a resin material.

8. The health rod according to claim 7, wherein the metallic material is an aluminum.

9. The health rod according to claim 7, wherein the resin material is a polycarbonate resin.

* * * * *